US006332224B1

(12) United States Patent
Walker et al.

(10) Patent No.: US 6,332,224 B1
(45) Date of Patent: Dec. 25, 2001

(54) KNEE PADS FOR INFANTS

(76) Inventors: Margaret A. Walker, 14748 Gilmore St., Van Nuys, CA (US) 91411; Jesus G. Raudales, 4241 Cartwright St., #107, North Hollywood, CA (US) 91601

( * ) Notice: Subject to any disclaimer, the term of this patent is extended or adjusted under 35 U.S.C. 154(b) by 0 days.

(21) Appl. No.: 09/866,847

(22) Filed: May 30, 2001

Related U.S. Application Data

(60) Provisional application No. 60/218,039, filed on Jul. 13, 2000.

(51) Int. Cl.[7] ..... A41B 11/00

(52) U.S. Cl. ..... 2/239; 2/24

(58) Field of Search ..... 2/24, 455, 22, 2/16, 60–62, 69, 75, 80, 83, 239–242, 59, 46; 603/23, 26, 62–63

(56) References Cited

U.S. PATENT DOCUMENTS

| | | | | |
|---|---|---|---|---|
| D. 312,147 | | 11/1990 | Lapin . | |
| D. 338,281 | | 8/1993 | Bottorff et al. . | |
| D. 344,609 | | 2/1994 | Lapin . | |
| D. 417,037 | | 11/1999 | Bitter . | |
| 4,035,844 | * | 7/1977 | Atack et al. | 2/22 |
| 4,250,578 | * | 2/1981 | Barlow | 2/24 |
| 4,287,885 | | 9/1981 | Applegate . | |
| 4,484,361 | | 11/1984 | Leighton et al. . | |
| 4,796,303 | | 1/1989 | Atwater . | |
| 4,845,778 | | 7/1989 | Peterson . | |
| 4,914,753 | | 4/1990 | Chang . | |
| 5,077,837 | | 1/1992 | Meistrell . | |
| 5,168,577 | | 12/1992 | Detty . | |
| 5,555,564 | * | 9/1996 | Welch | 2/239 |
| 5,784,721 | * | 7/1998 | Huff | 2/239 |
| 5,845,335 | | 12/1998 | Twitty . | |
| 6,158,051 | * | 12/2000 | Belzidsky | 2/22 |
| 6,178,555 | * | 1/2001 | Williams | 2/22 |

FOREIGN PATENT DOCUMENTS 2073009A 10/1981 (GB) .

* cited by examiner

*Primary Examiner*—John J. Calvert
*Assistant Examiner*—Tejash Patel
(74) *Attorney, Agent, or Firm*—Richard C. Litman

(57) ABSTRACT

A pair of socks and/or sock bands each incorporating knee pads to protect an infant's knees and feet from being scratched, rug burned, and scarred when crawling on a rug or floor's surface. The first embodiment incorporates knee pads into a pair of long socks having a one piece body including a leg portion with a knee region and a foot portion having a sole and toe region extending from the leg portion. The second embodiment incorporates knee pads into a sock band whereby each knee pad is sewn between the fabric used in each sock band. Each sock band can be made of a single sheet of fabric or made of two sheets of fabric sewn to snugly fit around the leg whereby the knee pad covers the patella of an infant.

9 Claims, 3 Drawing Sheets

KNEE PADS FOR INFANTS

CROSS-REFERENCE TO RELATED APPLICATION

This application claims the benefit of U.S. Provisional Patent Application Serial No. 60/218,039, filed Jul. 13, 2000.

BACKGROUND OF THE INVENTION

1. Field of the Invention

The present invention relates to knee pads, and more specifically, knee pads that are incorporated into a pair of socks or pair of short bands which protect an infant's knees and feet from being scratched, rug burned, or scarred while the infant is crawling on the floor.

2. Description of the Related Art

Problems associated with infants learning to crawl on their hands and knees have created injuries such as leaving their knees and feet both scarred, rug burned, and scratched. Knee pads for infants and toddlers have been the subject of patentability for many years in order to prevent and protect infants from these injuries.

The following design patents illustrate various examples of knee pads for infants, toddlers, and children.

U.S. Des. Pat. No. 312,147, issued to Randall H. Lapin on Nov. 13, 1990, reveals an ornamental design of a knee pad for babies, toddlers, and small children. The design includes padding material with two straps. U.S. Des. Pat. No. 344,609, also issued to Randall H. Lapin on Feb. 22, 1994, shows an ornamental design of knee pads for babies, toddlers, and small children. The design includes padding material with four straps.

U.S. Des. Pat. No. 338,281, issued to Lorrie Bottorff, et al. on Aug. 10, 1993, presents an ornamental design of an infant knee pad. The design includes padding with a looped strap. U.S. Des. Pat. No. 417,037, issued to John D. Bitter on Nov. 23, 1999, depicts an ornamental design of a knee pad for crawling infants. The design includes a picture of a bear on the pad and two straps extending from the pad.

U.S. Pat. No. 4,287,885, issued to Leslie T. Applegate on Sep. 8, 1981, explains a knee brace with a resilient pad surrounding the patella. The knee brace includes an elastic stretchable sleeve. The knee brace also includes a flexible sheet of non-stretchable material in a circumferential direction secured to the interior of the sleeve which is configured and dimensioned to surround a substantial portion of the user's patella.

U.S. Pat. No. 4,484,361, issued to Kenneth B. Leighton, et al. on Nov. 27, 1984, characterizes a knee and elbow pad and method of making the same. The pad includes an elasticized sleeve which surrounds the joint to be protected and a pad assembly fastened to the sleeve. The pad assembly includes a fabric covering over a polyurethane foam backing. A recess is formed in the polyurethane by pressing a hot die into it and a dense, modified polyurethane is cast in the recess. The combination of polyurethane foam and dense, modified polyurethane provides superior shock absorption and protection from impact.

U.S. Pat. No. 4,796,303, issued to W. David Atwater on Jan. 10, 1989, describes a knee protector pad which is adapted for use by volleyball players. The protector pad includes an elastic sleeve enclosing the knee and adjacent portions of the leg of the wearer. A flat elastomeric foam pad is completely enclosed in a knit sleeve and bar tack stitching attaches spaced-apart portions of the upper and lower edges of the knit sleeve to the elastic sleeve to maintain the pad in position.

U.S. Pat. No. 4,845,778, issued to Leslie A. Peterson on Jul. 11, 1989, discusses a child's crawler garment and a method of making the garment. The garment is a pair of pants having leg portions which are formed in the vicinity of the knee area with a design made of a thermal heat setting material. U.S. Pat. No. 4,914,753, issued to Cheng-Shung Chang on Apr. 10, 1990, teaches an athletic knee pad having a padded front section, an elastic rear section, an adjustable upper elastic sleeve, and an elastic lower sleeve of a smaller diameter than the main body of the pad.

U.S. Pat. No. 5,077,837, issued to William R. Meistrell on Jan. 7, 1992, defines a knee or elbow protector having a flexible, relatively thin wall tube that is bi-directionally stretchable. The tube includes inner and outer sides with opposite ends and sides to be stretched when slipped onto the leg or arm to cover the knee or elbow.

The tube includes a first elastomeric layer and a second layer of stretchable fabric attached to and substantially covering one side of the first layer. An elastic foam pad is located adjacent the outer side of the tube and spaced from the opposite side. There is a retention fabric closely covering the pad and defining a loop-shaped peripheral portion that is attached to the tube.

U.S. Pat. No. 5,168,577, issued to Gerald D. Detty on Dec. 8, 1992, comments on an elbow and knee sleeve with seams on opposite sides of the sleeve. The seams are placed on the opposite sides of the sleeve to prevent the bunching of material. The knee brace is made of a triple laminate with elastomeric material sandwiched between two layers of nylon.

U.S. Pat. No. 5,845,335, issued to Floleather Twitty on Dec. 8, 1998, instructs a noise making garment for producing sounds when each noise pad is compressed. Great Britain Pat. No. 2,073,009A, issued on October of 1981, discusses improvements in or relating to leg guards. The leg guards include a first outer layer of plastic material which provides an impact resistant surface and a second inner layer which provides a resilient padding for the leg of the user.

Ideal knee padding wear would not only protect an infant's knees and feet from being scarred and scratched up, but also be part of the infant's everyday clothing.

None of the above inventions and patents, taken either singly or in combination, is seen to describe the instant invention as claimed.

SUMMARY OF THE INVENTION

The present invention relates to knee pads that are incorporated into either a pair of socks and a pair of short bands, which when worn, protect an infant's knees and feet from being scratched, rug burned, and scarred when crawling on a rug or floor's surface.

In the first embodiment, the knee pads are incorporated into a pair of long socks having a one piece body including a leg portion with a knee region and a foot portion having a sole region extending from the leg portion. An elastic-like material such as an elastic band can be sewn into each sock between the leg portion and the foot portion to give the sock a better fit.

In the second embodiment, the knee pads are incorporated into a sock band whereby a knee pad which is dimensioned and configured to the size of an infant's patella is sewn into the sheet of fabric used in each sock band. Each sock band can be made of a single sheet of fabric or made of two sheets of fabric sewn to snugly fit around the leg whereby the knee pad covers the patella of an infant.

Accordingly, it is a principal object of the invention to provide a pair of socks and/or sock bands, each incorporating a knee pad to protect an infant's knees and feet from being scratched, rug burned, and scarred when crawling on a rug or a floor's surface.

It is another object of the invention to provide a pair of socks each incorporating a knee pad that also may include padded areas in the sole and toe regions.

It is a further object of the invention to provide a pair of socks and/or sock bands each incorporating a knee pad that is made from a material that is comfortable, durable, and easy to wash.

Still another object of the invention is to provide a pair of socks and/or sock bands each incorporating a knee pad that is made from a material that is manufactured in a number of colors and patterns for aesthetic and amusement purposes.

It is an object of the invention to provide improved elements and arrangements thereof knee pads for infants in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
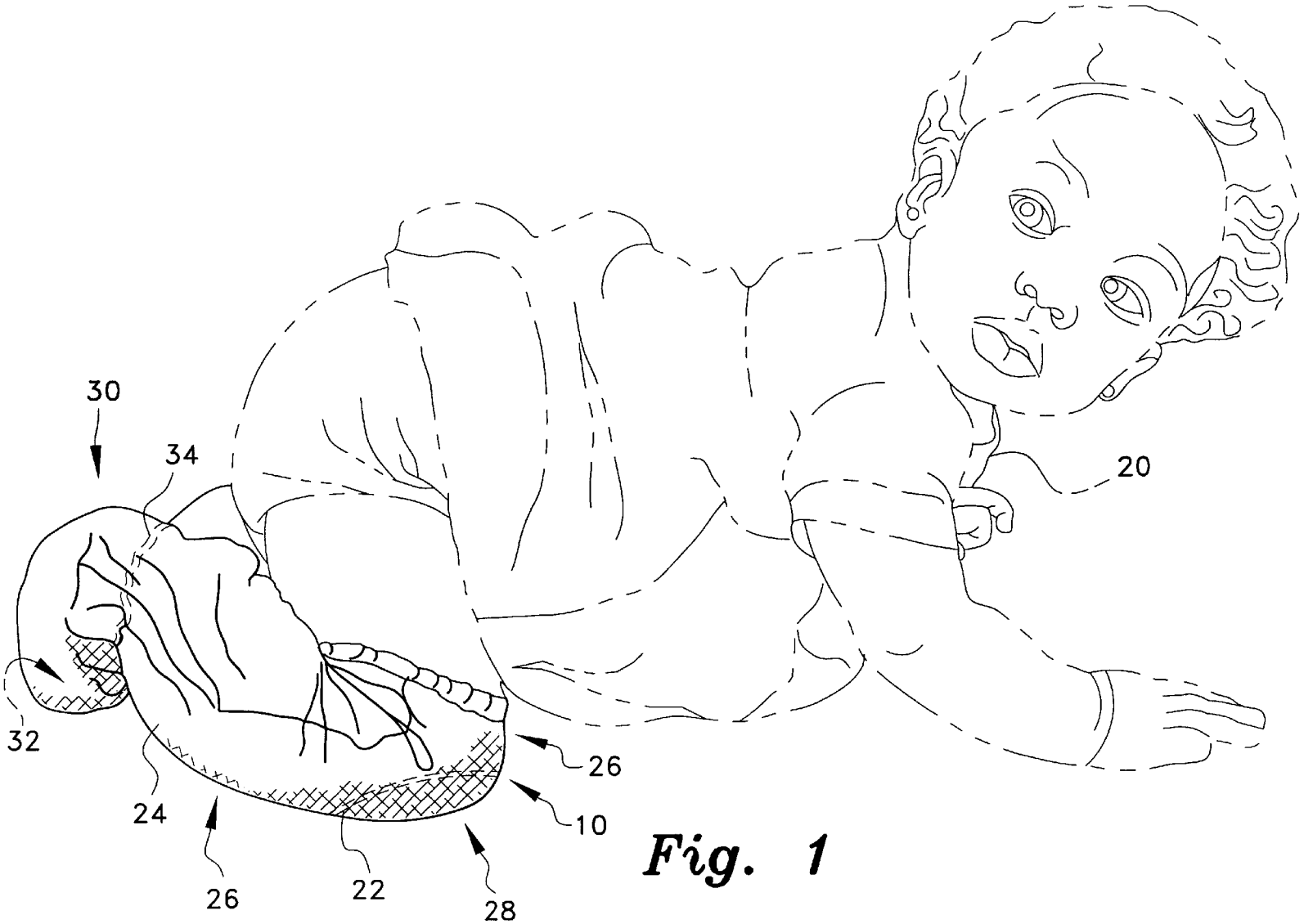
FIG. 1 is an environmental perspective view of an infant wearing a pair of socks incorporating knee pads according to the present invention.

The present invention relates to knee pads that are incorporated into a pair of socks and a pair of short bands which when worn, protect an infant's knees and feet from being scratched, rug burned, and scarred when crawling on a rug or a floor's surface designated as 10 in the drawings. There are two embodiments of the present invention whereby the knee pads are incorporated either into a pair of socks or a pair of sock bands both covering and protecting an infant's knees.

FIG. 1 illustrates an infant 20 utilizing the first embodiment 10 of the knee pads 22 incorporated into a pair of socks 24. In the first embodiment 10, knee pads 22 are incorporated into a pair of long socks 24 having a one piece body including a leg portion 26 with a knee region 28 and a foot portion 30 having a sole and toe region 32 extending from the leg portion 26. An elastic-like material 34 such as an elastic band can be sewn into each sock between the leg portion 26 and the foot portion 30 to give a better fit.

Figure 2:
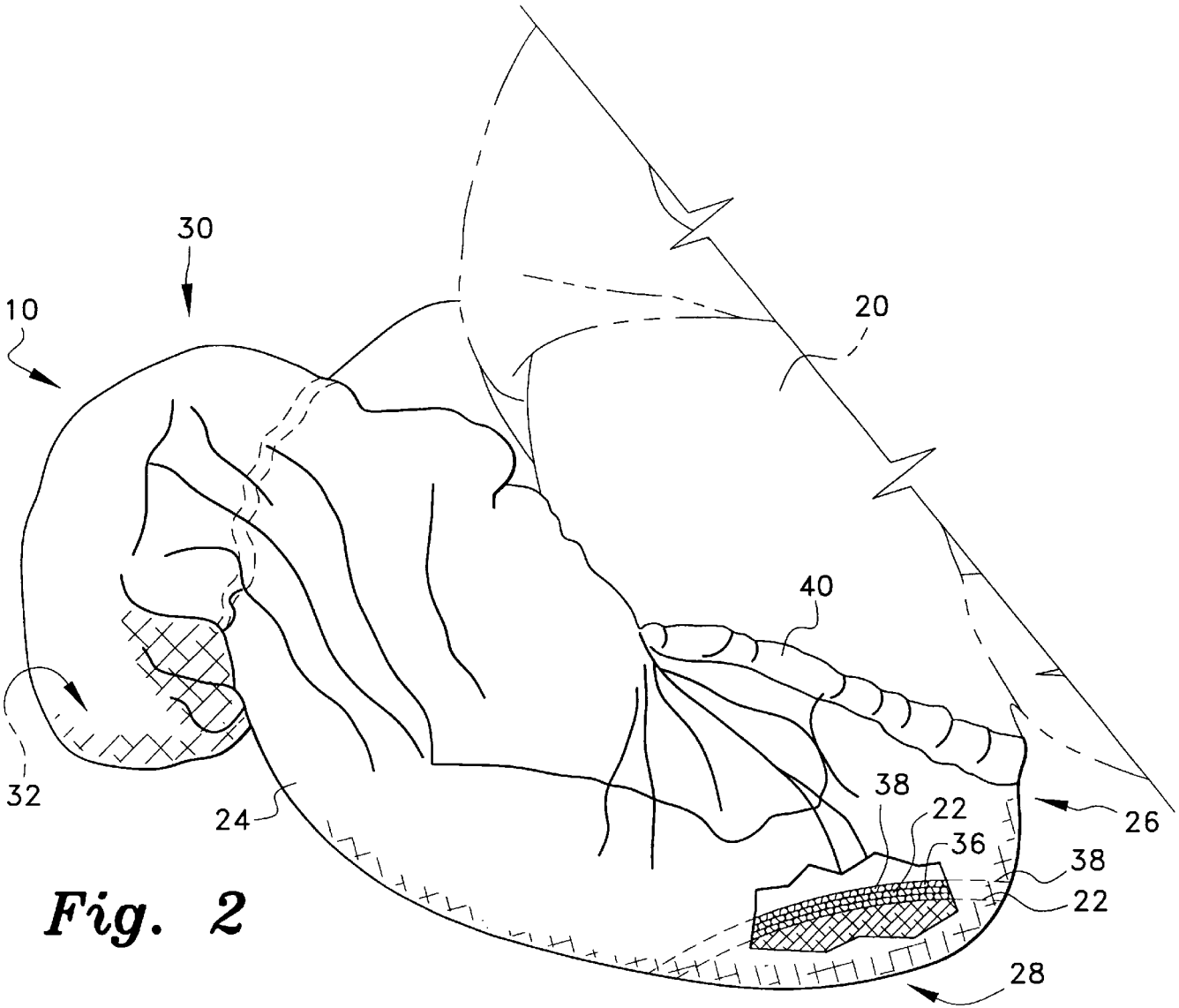
FIG. 2 is an exploded view of the material layers that make up the area of the sock that contains the knee padding of the present invention.
Figure 3:
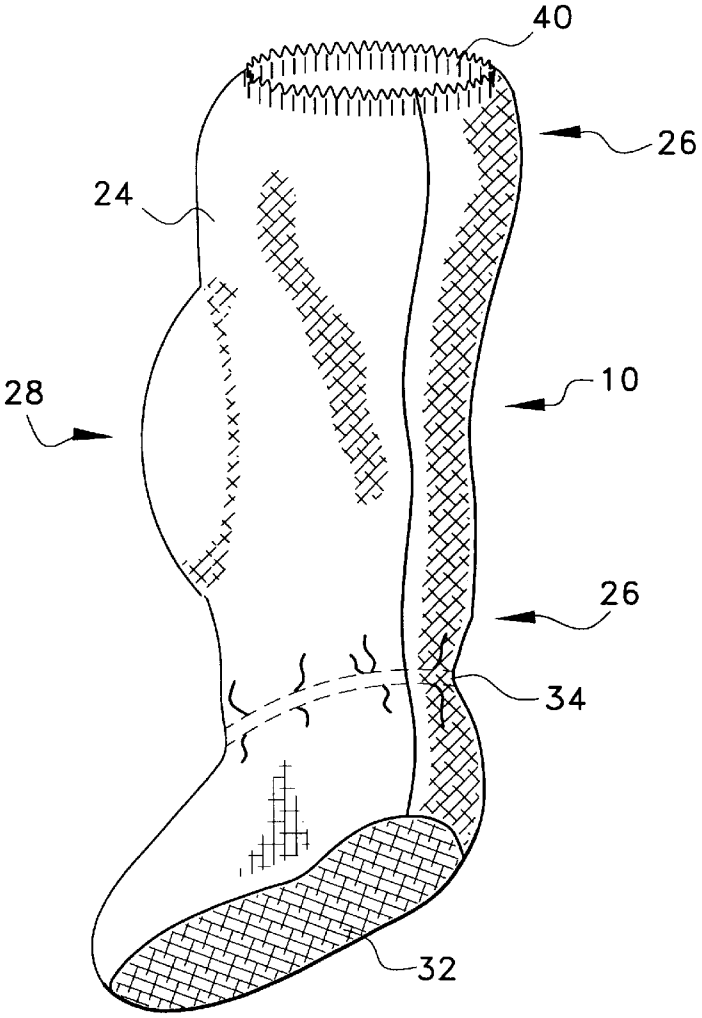
FIG. 3 is a side view of the first embodiment having the knee pad incorporated in a leg sock of the present invention.

FIGS. 2 and 3 shows the first embodiment 10 of the knee pad 22 revealing the padding within the knee region 28 of each sock 24. Although only one sock 24 incorporating the knee pad 22 can be the present invention by itself, a pair of socks 24, each incorporating a knee pad 22 is the preferred method of manufacturing the invention. The socks 24 incorporating knee pads 22 comprise at least one sheet of precut fabric 36 being dimensioned and configured to loosely fit the shape of a leg of an infant 20. If one sheet of fabric 36 is utilized to make each sock 24, then a smaller patch of similar material 38 is dimensioned and configured to be the same size and shape of the knee pad 22 that will be sewn between the small patch of material 38 and the sheet of fabric 36.

If at least two sheets of fabric 36 are utilized in the first embodiment 10, then the two sheets of fabric 36 will be of equal size and sewn together to form each entire sock 24 that is dimensioned and configured to wear on the leg of an infant 20. A knee pad 22 will be inserted in the knee region 28 of each sock 24 between the two sheets of fabric 36 and to hold the knee pad 22 in place, the two sheets of fabric 36 will be sewn around the knee pad 22 and knee region 28 to retain the pad firmly over the patella of an infant 20.

At the top of the leg portion 26 includes an elastic or elastic-like band 40 sewn into the sock 24 for keeping the top part of the leg portion 26 comfortable and snugly fit on an infant's thighs 20. If one sheet of fabric 36 is used to make each sock 24, then the elastic-like band 40 can be folded and sewn into the top of the one sheet of fabric 36 of the leg portion 26. If two sheets of fabric 36 are used to make each sock 24, then the elastic-like band 40 can be sewn into the top of the leg portion 26 and between each sheet of fabric 36. The foot portion 30 of each sock 24 may include a padded sole and padded toe region 32 to prevent the material in that area from wearing out through excessive use. These padded areas 32 will also be sewn onto the outer surface of the fabric sheet 36 in the foot portion 30 of each sock 24.

Figure 4:
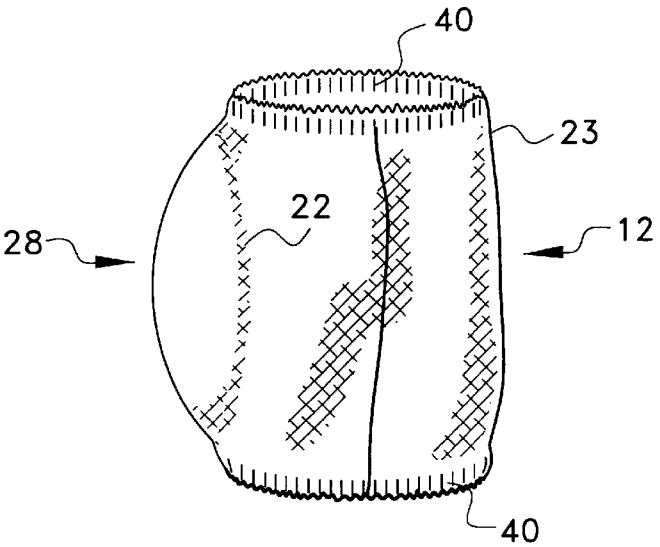
FIG. 4 is a side view of the second embodiment having the knee pad being the size of the sock band and patella of an infant of the present invention.

FIG. 4 illustrates the second embodiment 12 of the knee pad 22 incorporated in a sock band 12. In the second embodiment 12, the knee pads 22 are incorporated into a sock band 12 whereby each knee pad 22 is sewn between or within the sheet(s) of fabric 23 used in each sock band 12. Each sock band 12 can be made of a single sheet of fabric 23 or made of two sheets of fabric 23 sewn together and is dimensioned and configured to snugly fit around the leg whereby the knee pad 22 covers the patella of an infant.

Preferably, each sock band 12 would be made of one sheet of fabric 23 and a small patch of a second piece of fabric dimensioned and configured to be the same shape as the knee pad 22, but slightly larger in size would be used in order to be sewn onto the knee region 28 of the sock band 12. Each sock band 12 includes an elastic-like band 40 to be sewn into the top and bottom of the sheet(s) of fabric 23 used in the same manner as sewn into the top of the sheets of fabric 24 used in the first embodiment 10.

In both embodiments 10 and 12, the fabric 23 and 24 will be made from a material that is comfortable, durable, and easy to wash. For example, flannel would be the preferred type of material utilized in the present invention 10 and 12 for the cold winter months and light weight cotton could be used for the hot summer months because the fabric breathes better to decrease the need for the skin to sweat. The fabric 23 and 24 utilized may be manufactured in a number of colors and patterns for aesthetic and amusement purposes.

It is to be understood that the present invention is not limited to the sole embodiments described above, but encompasses any and all embodiments within the scope of the following claims.

We claim:

1. A sock incorporating a knee pad comprising:

at least one sock having at least one sheet of fabric being precut and sewn together to cover a leg of an infant, said at least one sock having a leg portion, a knee region, and a foot portion, said leg portion having a top area;

at least one knee pad sewn into said knee region for protecting an infant's patella, said at least one knee pad being dimensioned and configured to cover the infant's patella;

a small patch of material dimensioned and configured to the shape of said at least one knee pad, said small patch of material enclosing said at least one knee pad onto said knee region of said at least one sock and sewn to said at least one sheet of fabric to hold said at least one knee pad in place;

a first elastic-like material sewn into said top area of said leg portion for holding said at least one sock on a leg of the infant; and a second elastic-like material sewn into said at least one sock between said leg portion and said foot portion.

2. A sock incorporating a knee pad according to claim 1, wherein said at least one sheet of fabric is made from a material that is comfortable, durable, and easy to wash.

3. A sock incorporating a knee pad according to claim 1, wherein said foot portion incorporates padding therein.

4. A sock incorporating a knee pad according to claim 1 wherein said at least one sheet of fabric is colored and decorated.

5. A sock incorporating a knee pad comprising:

at least one sock each having at least two sheets of fabric being precut and sewn together to cover the leg of an infant, said sock having a leg portion, a knee region, and a foot portion, said leg portion having a top area;

at least one knee pad for protecting the patella of an infant, said at least one knee pad being sewn between said two sheets of fabric at said knee region of said sock, each said knee pad dimensioned and configured to cover the entire patella of an infant; and a first elastic-like material being sewn into said top area of said leg portion of said sock for holding said sock on the leg of an infant.

6. A sock incorporating a knee pad according to claim 5, further comprising a second elastic-like material being sewn into each said sock between said leg portion and said foot portion.

7. A sock incorporating a knee pad according to claim 5, wherein said sheet of fabric of said sock is made from a material that is comfortable, durable, and easy to wash.

8. A sock incorporating a knee pad according to claim 5, wherein said foot portion incorporates padding therein.

9. A sock incorporating a knee pad according to claim 5, wherein said sheet of fabric is colored and decorated.

* * * * *